US011752664B1

(12) United States Patent
Maltese et al.

(10) Patent No.: US 11,752,664 B1
(45) Date of Patent: Sep. 12, 2023

(54) THERMOFORMED WALL SKIN SHEET WITH BACKER GUIDE

(71) Applicants: Daniel Maltese, Agoura Hills, CA (US); Scott Pitters, Hollywood, CA (US)

(72) Inventors: Daniel Maltese, Agoura Hills, CA (US); Scott Pitters, Hollywood, CA (US)

(73) Assignee: Pulp Art Surfaces LLC, Studio City, CA (US)

( * ) Notice: Subject to any disclaimer, the term of this patent is extended or adjusted under 35 U.S.C. 154(b) by 1,104 days.

(21) Appl. No.: 15/946,723

(22) Filed: Apr. 5, 2018

Related U.S. Application Data

(63) Continuation-in-part of application No. 15/833,599, filed on Dec. 6, 2017 (U.S. filing date under 35 U.S. C. 384), and having an international filing date of Feb. 21, 2018, now Pat. No. 10,486,331, which is a continuation of application No. 14/050,026, filed on Oct. 9, 2013, now abandoned, which is a continuation-in-part of application No. 13/410,481, filed on Mar. 2, 2012, now abandoned.

(60) Provisional application No. 62/483,301, filed on Apr. 7, 2017.

(51) Int. Cl.
*B28B 7/22* (2006.01)
*E04F 21/04* (2006.01)

(52) U.S. Cl.
CPC ... *B28B 7/22* (2013.01); *E04F 21/04* (2013.01)

(58) Field of Classification Search
CPC ..... B28B 7/22; E04F 21/04
See application file for complete search history.

(56) References Cited

U.S. PATENT DOCUMENTS 4,467,578 A * 8/1984 Weinar ..... E04B 2/7457 52/281
2007/0034346 A1* 2/2007 Salm ..... D21J 3/00 162/218

OTHER PUBLICATIONS https://web.archive.org/web/20140801000000*/https://www.nuformdirect.com/products-solutions/products/reline/.*
ReLine, Wall Paneling System for Renovations and New Construction, NuForm, 2013 (Year: 2013).*

* cited by examiner

*Primary Examiner* — Tong Guo
(74) *Attorney, Agent, or Firm* — David M. Kleiman

(57) ABSTRACT

A solid aesthetic wall skin sheet having a backer guide with tabs and recesses which is manufactured using thermoform molding. The thermoformed wall skin sheet with a backer guide offers improved printability on the top display surface and facilitates the easy application of multiple wall skins sheets that can be joined together onto a wall surface to form a wall covering that has accurate and tight-fitting seams and conceals from view the fasteners used.

19 Claims, 6 Drawing Sheets

THERMOFORMED WALL SKIN SHEET WITH BACKER GUIDE

This application is a continuation-in-part of U.S. Pat. application 15/833,599 filed on Dec. 6, 2017, which is a continuation of U.S. Pat. application 14/050,026 filed on Oct. 9, 2013, which was a continuation-in-part of U.S. Pat. application 13/410,481 filed Mar. 2, 2012, the benefit of priority for each of the aforementioned applications being claimed here and the full contents of each of which are hereby incorporated by reference. This application also claims the benefit of priority of U.S. provisional Pat. application 62/483,301 that was filed on Apr. 7, 2017 the contents of which are also hereby fully incorporated by reference.

TECHNICAL FIELD

The present invention relates to the field of wall and surface coverings and more particularly the making of a three-dimensional wall covering having aesthetic features and finishes.

SUMMARY OF THE INVENTION

A "wall skin sheet" as that term is used herein is an aesthetic three-dimensional sheet of solid material having a top display surface with one or more ornamental portions. A wall skin sheet is intended to be applied to a surface for decorative purposes. Wall skin sheets are used in film, television, theater, commercial stores, offices, and residential homes.

It is an object of the invention to provide an environmentally friendly wall skin sheet product that is biodegradable and recyclable using recycled paper (molded pulp).

It is also an object of the invention to provide a wall skin sheet in various shapes, sizes and thicknesses, and in an almost limitless variety of surface patterns which simulate brick, flag stone, rocks, architectural ornamentation and the like.

It is also an object of the invention to provide a wall skin sheet which may comprise one or more elements, includes aesthetically pleasing patterns on a display surface, that can be easily attached to and fitted on an existing surface without the need for using expensive and/or toxic adhesives. The wall skin sheets that are produced according to the methods disclosed herein may also find use as acoustical elements in studios, theaters and the like or in drop ceilings.

A slush molding method for the manufacture of aesthetic wall skin sheets includes the steps of: preparing a mockup of the wall skin with the desired surface pattern; creating a tool from the mockup, preparing a slurry of recycled paper, newspaper, paperboard and water; creating the basic wall skin by the use of slush molding of the slurry to shape the wall covering and eliminate the water from the slurry; drying the wall covering; cutting the covering to create one or more elements; and creating a surface pattern by finishing, sculpting, sanding, embossing or printing details on the display surface.

Production of an aesthetic wall skin sheet using the slush molding method produces a sheet with a top surface that is relatively smooth, and a bottom surface that is relatively rough. Slush molding, as used during the manufacturing method produces wall coverings with uneven front and rear surfaces, which does not readily facilitate the use of adhesives for wall mounting. Accordingly, the wall skin sheets produced in accordance with the slush molding method may be attached to an existing surface or wall using conventional mechanical fasteners such as screws, nails or staples.

It has also been found that the oven drying step in the slush molding method of manufacture molded fiber product method can fail to provide acceptable tolerances, consistent dimensions, and flat aesthetic wall skin sheets. Even when the aesthetic wall skin sheets are within tolerance the elements of the aesthetic wall skin sheet can take on unpredictable shapes and positions because the recycled newsprint and paper that goes into the paper pulp mixture used in the process can vary in consistency. This is inherent in said first slush molding method employed using recycled materials.

Die or CNC cutting of the wall skin sheets according to the slush molding method has been found to allow for adjacent elements to be better fitted together and reduces or eliminates the need to caulk the joints between adjacent wall skin sheets. The dimensions of the wall skin sheets have to be accurate in order to die cut them properly. The applicants have found that by adding a surplus of material beyond the intended finished die-cut patterned design of the wall skin sheet this helps to solve the problem of parts warping and "potato chipping" as they free dry on a conveyor belt going through the drying oven. Thus, the wall skin sheets will have better tolerance in dimensions and detail and fit together more precisely.

Surface finishing of the ornamental portions of the display surface of the wall skin sheets includes shaping and texturing procedures, which may include, but not be limited to, sanding, carving, sculpting, stamping, printing and embossing to attain the desirable surface features, contours and textures.

Once the display surface of the wall skin sheets have been finished to create a desired pattern or contour, coatings may be applied to the display surface, such as by way of digital printing, to impart colors, images, designs, messages, etc.. . However, the top ornamental surfaces produced using slush molding can often be very grainy and porous making it difficult or impossible to effectively apply such coatings.

Furthermore, when the aesthetic wall skin sheet top display surface is digitally printed on it can be extremely difficult to find an available paint color that will match the applied color, design and/or image. This can prevent the effective patching over with paint of mechanical fasteners (e.g. screws, staples, nails, etc...) that may have been used for installation of the aesthetic wall skin sheet. The slush molding process also typically produces a very rough finish on the bottom side of the wall skin sheet which can prevent the wall skin sheet from being secured sufficiently under suction to a digital printer conveyor belt or table system. This can adversely affect the ability to print well on the wall skin sheet.

One or more wall skin sheets, each having display surfaces with one or more ornamental portions, may be arranged together to form a pattern on a surface to which they are attached. It has been found that users of a wall skin sheet will often fasten the wall skin sheet to a surface using staples or screws that can be difficult and costly to hide from view after installation. Multiple aesthetic wall skin sheets must often be used together to cover a desired surface area on a surface. To achieve the desired visual appearance this requires that the multiple aesthetic wall skin sheets used fit together on the surface accurately and tightly. Even a small gap between installed wall skin sheets can grow horizontally and vertically resulting in a situation that is not visually acceptable to an end user.

Accordingly, applicants have invented a new wall skin sheet that is preferably made by a thermoforming pulp molding process. The new wall skin sheet helps resolve the aforementioned issues of gaps between adjacent wall skins when installed and the difficulty of using digital printing with wall skins manufactured using the slush molding process.

As described in greater detail herein the applicants' inventive new wall skin includes the new feature of a backer guide that facilitates the installation of multiple wall skin sheets onto a wall surface with accurate and tight-fitting joints so that there will be no gaps between adjoining aesthetic wall skin sheets, and any mechanical fasteners that may be used in installation will be hidden from view.

As also described in greater detail herein, the preferred method of making the applicants' new wall skin with a backer guide is a thermoforming process instead of the slush molding process. The thermoforming process can produce smoother surfaces and eliminate the problems caused by the oven drying used in slush molding, all of which helps to facilitate installation and the ability to digitally print on the top ornamental surface of the wall skin sheet.

DETAILED DESCRIPTION

Figure 1:
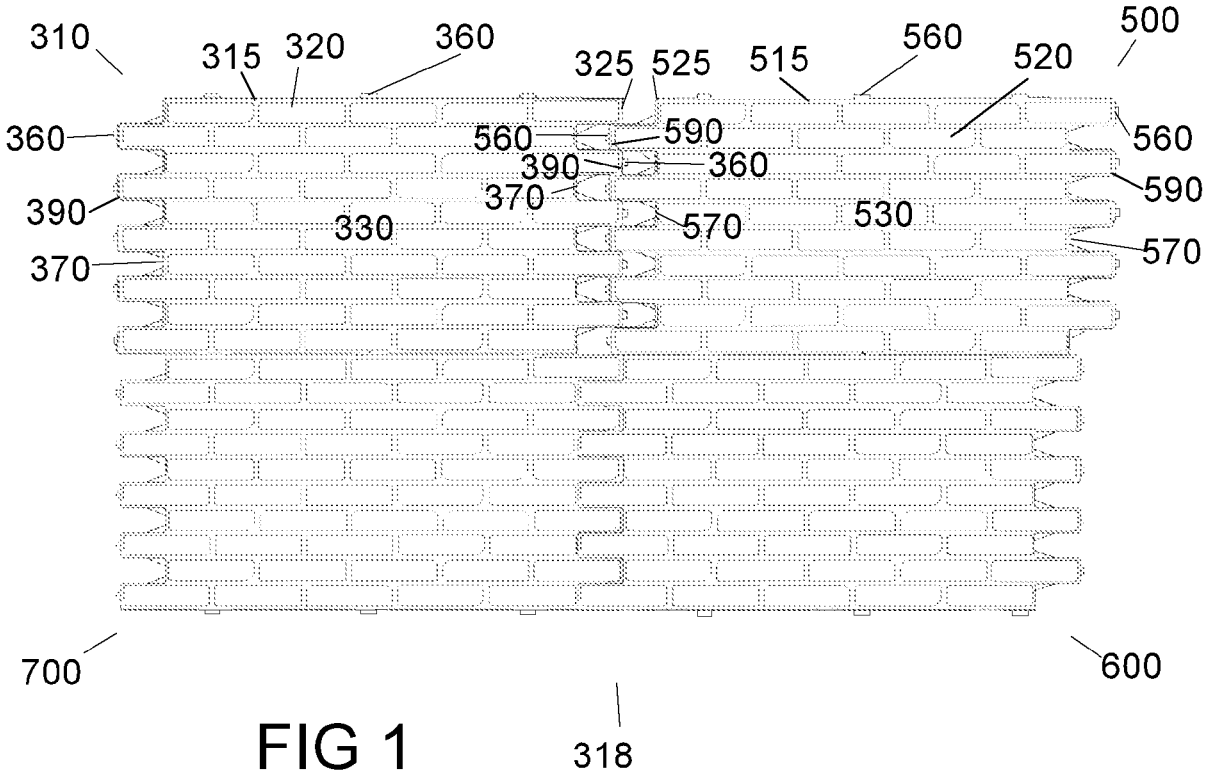
FIG. 1 is a top view of a wall covering comprised of a plurality of wall skin sheets having backer guides, with a wall skin sheet positioned to be joined to an adjacent aesthetic wall skin sheet.
Figure 2:
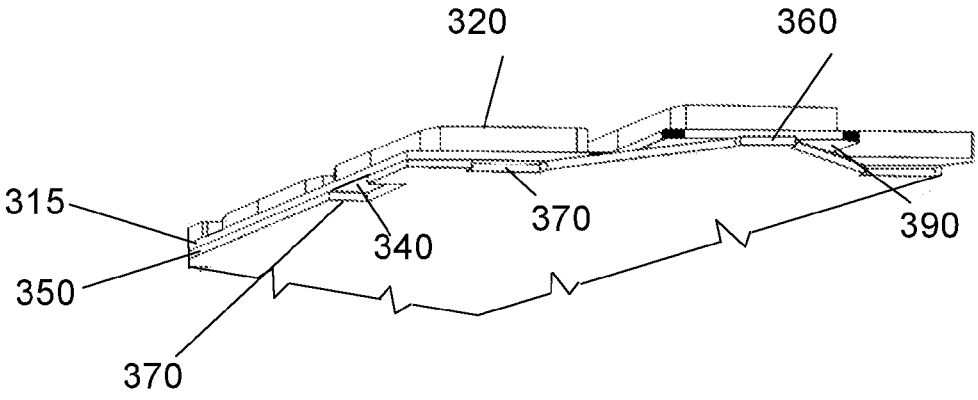
FIG. 2 is an enlarged bottom elevation perspective view of an edge portion of wall skin sheet with a backer guide attached.
Figure 3:
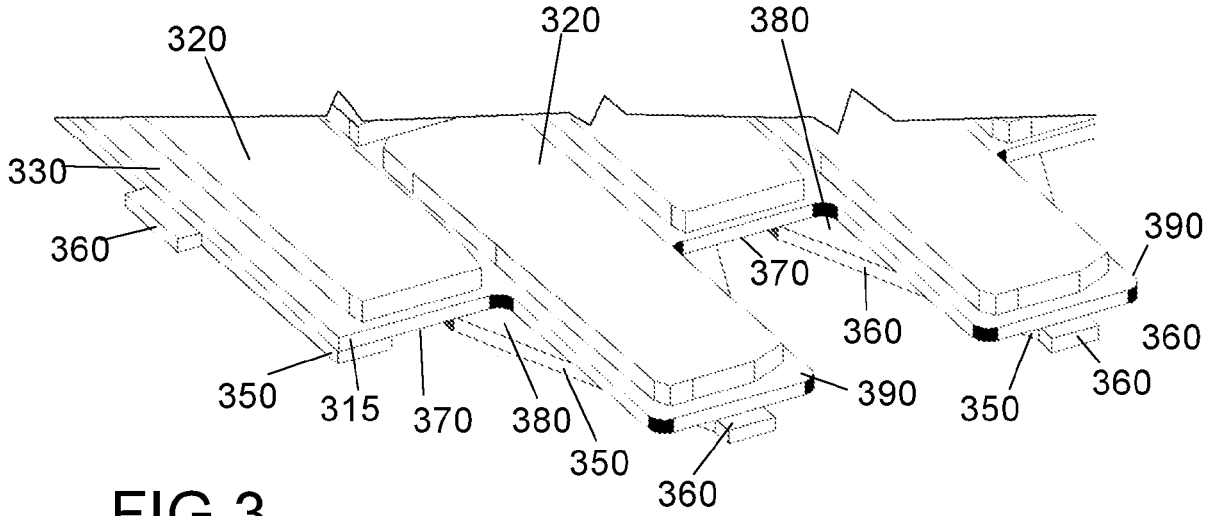
FIG. 3 is an enlarged top elevation perspective view of an edge portion of a wall skin sheet with a backer guide attached.

Referring to FIG. 1 a preferred embodiment is illustrated of aesthetic wall skin sheets 310 being joined together. Each aesthetic wall skin sheet 310 comprises a wall skin sheet body 315 having a top display surface 330 and a bottom hidden surface 340. At least one ornamental portion 320 is located on display surface 330. An ornamental portion may be, by way of example and not limitation, an embossed feature in the shape, pattern, and/or texture of a certain type of wall construction material. In FIG. 1 ornamental portion 320 is in the form of a brick, such that when installed on a wall surface multiple aesthetic wall skin sheets 310 may be combined into a wall skin covering 318 that gives the appearance of a brick wall. It is anticipated that display surfaces 330, including ornamental portions 320, may have one or more coatings applied to them that are colors, designs, and/or images to convey the desired visual impression (e.g. red clay brick, river rocks, etc.. ..).

While the embodiment shown in FIG. 1 is one with ornamental portions 320 being in the form of bricks, it should be noted that the ornamental portions 320 may be representative of any shape, pattern, or texture including, by way of example and not limitation, brick, flagstone, cut stone, cement block, tile, river rock, stucco, wood, etc....

Referring to FIGS. 1-5 in the preferred embodiment of the present invention there is a backer guide 350 that is attached to bottom hidden surface 340 of body 315 of aesthetic wall skin sheet 310. Backer guide 350 has one or more tabs 360 and recesses 370 all of which are located beneath wall skin sheet display surface 330 when backer guide 350 is attached. An exposed fastener area 380 of tab 360 extends out from beneath display surface 330 beyond the periphery edge 390 of wall skin sheet body 315.

When applying aesthetic wall skin sheets 310 onto a surface to make a wall covering 318 the backer guide 350 of a first aesthetic wall skin sheet 310 is first placed against the surface in a desired location and then is fastened to the wall surface by installing one or more fasteners (e.g. one or more staples, nails or screws) through one or more fastener areas 380 that extend beyond the periphery edge 390 of body 315 of first aesthetic wall skin sheet 310. This secures the first aesthetic wall skin sheet 310 to the wall surface.

After installation of a first aesthetic wall skin sheet 310 as described above a second aesthetic wall skin sheet 500 to be applied to the wall surface adjacent to the fastened first aesthetic wall skin sheet 310 may be installed by interlocking (i.e. keying into place) complimentary tabs and recesses of the first and second aesthetic wall skin sheets. Accordingly, second aesthetic wall skin sheet 500 is manually placed on the surface and positioned (e.g. by a sliding action) such that tabs 360 and 560 will interlock with complimentary recesses 370 and 570 of the first aesthetic wall skin sheet 310. The interlocking of a tab and recess forms a finger joint.

More specifically, the backer guide 550 of the second aesthetic wall skin sheet 500 is placed substantially against the wall surface, and aesthetic wall skin sheet 500 is then positioned manually such that each tab 560 located along joining edge 525 of the second aesthetic wall skin sheet 500 is inserted into a complimentary recess 370 on joining edge 325 of the backer guide 350 of the first aesthetic wall skin sheet 310 to form a finger joint. Likewise, each tab 360 located along joining edge 325 of the first aesthetic wall skin sheet 310 is at the same time inserted into a complimentary recess 570 located along the joining edge 525 of the backer guide 550 of the second aesthetic wall skin sheet 500 to form a finger joint.

Once the first aesthetic wall skin sheet 310 and second aesthetic wall skin sheet 500 have been so joined together along their complimentary joining edges any previously visually exposed fastener areas 380 of backer guide 350 (and any fasteners installed in them) of the first aesthetic wall skin 310 that extended beyond the peripheral edge 390 of body 315 of the first aesthetic wall skin sheet 310 will be covered and concealed from view by the now overlapping periphery edge 590 of body 515 of second aesthetic wall skin sheet 500. Tabs 360 will also be concealed from view when located in recesses 570 that are beneath body 515 of second aesthetic wall skin sheet 500. Likewise, any previously visually exposed fastener areas 580 of backer guide 550 (and any fasteners installed in them) of the second aesthetic wall skin 500 that may extend beyond the peripheral edge 590 of body 515 of the second aesthetic wall skin sheet 500 will be covered and concealed from view by the now overlapping periphery edge 390 of body 315 of first aesthetic wall skin sheet 310. Tabs 560 will also be concealed from view when located in recesses 370 that are beneath body 315 of first aesthetic wall skin sheet 310. Additional wall skin sheets (e.g. sheets 600 and 700 shown in FIG. 15) can be installed in similar fashion until the desired area of wall surface is covered. Outer edges of a wall skin covering 318 may be trimmed using conventional tools to conform to the desired outer edge appearance.

While aesthetic wall skin sheet 310 with backer guide 350 of the present invention may be manufactured using any conventional materials or manufacturing processes, it is contemplated that the present invention would be made from environmentally friendly materials such as, by way of example and not limitation, paper pulp from recycled paper products. More specifically, it is contemplated that aesthetic wall skin sheets 310 of the present invention would be made from a pulp composition comprised mostly of materials from recycled and/or biodegradable sources, such as by way of example, recycled newsprint or paper products. It is further contemplated in the preferred embodiment that the aesthetic wall skin sheet bodies 315 of the present invention and/or backer guides 350 be manufactured using a thermoform pulp molding process.

There are different processes used for manufacturing molded fiber products. One method which may be used for manufacturing a wall skin of the present invention is slush molding (i.e. "Type 1"). In slush molding the wall skin sheet body 315 is manufactured from a liquid fiber mixture (preferably recycled paper fibers) which is placed into a mold that has been fabricated to impart the desired shape and/or ornamental portions 320 to the aesthetic wall skin sheet body 315 to be produced. Liquid is then extracted from the mixture in the mold under vacuum pressure. Once the desired amount of liquid has been removed the resulting aesthetic wall skin sheet part is removed from the mold "wet" and is then placed in an oven having an elevated temperature to be dried (i.e. cured).

Another type of pulp molding process is the "thermoformed fiber" process, also known as Type 3 pulp molding. In Type 3 pulp molding heated molding surfaces are utilized. These heated molding surfaces make the product more precise in shape and the material denser. The heated molding surfaces also make it unnecessary to have a separate oven drying step. This is the preferred method for manufacturing the wall skin sheets of the present invention.

Figure 11:
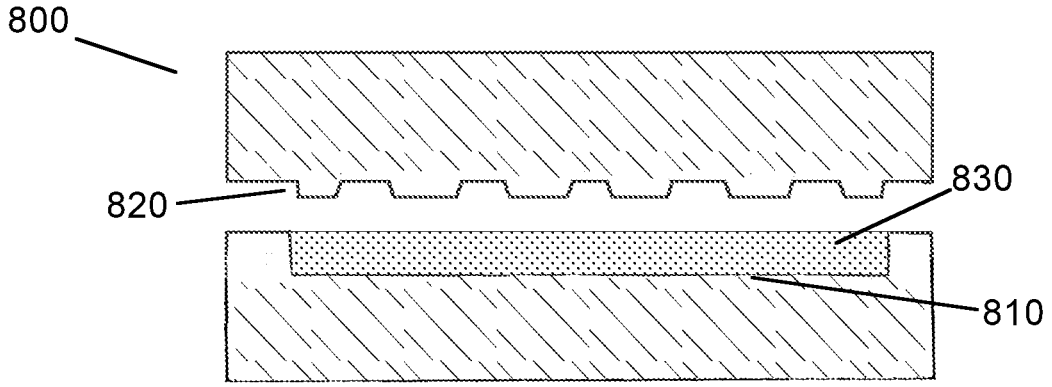
FIG. 11 is a cross-sectional view of a mold used to manufacture the wall skin sheet without the backer guide attached yet in an open configuration.
Figure 12:
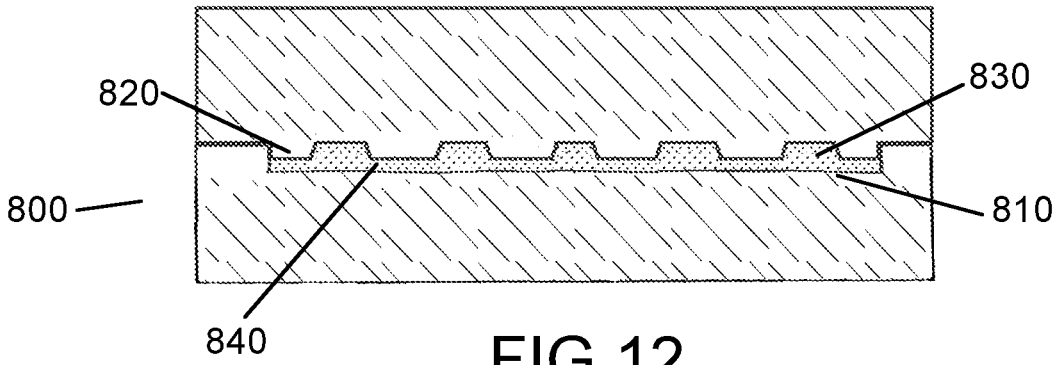
FIG. 12 is a cross-sectional view of the mold of FIG. 11 in a closed configuration.
Figure 13:
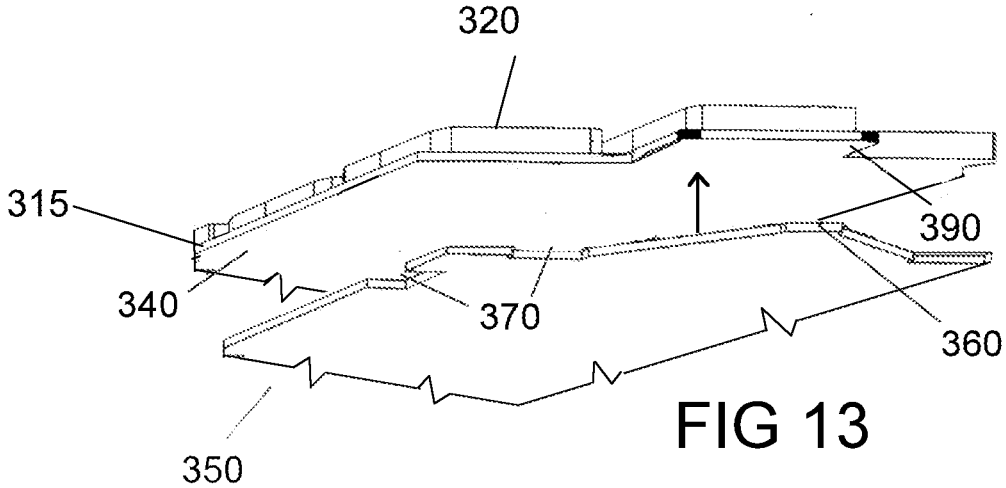
FIG. 13 is an enlarged bottom elevation perspective view of an edge portion of wall skin sheet showing the separate backer guide prior to it being attached to the hidden surface of the wall skin sheet.

Referring generally to FIGS. 11-13, in the contemplated Type 3 molded fiber product thermoform process the wall skin sheet body 315 and/or backer guide 350 are preferably made from a liquid paper fiber mixture, and use heated molding surfaces without any oven drying step.

Referring to FIG. 11 a mold 800 used to manufacture wall skin sheet body 315 is shown in cross section in an open configuration. Mold 800 has a first molding surface 810 to which a fluid wall skin body composition 830 is applied. In the preferred embodiment fluid wall skin body composition 830 is an aqueous paper pulp slurry comprised of recycled paper fibers. In the exemplary embodiment illustrated first molding surface 810 has a "female" configuration with an open recess to receive fluid wall skin body composition 830 when it is applied. Mold 800 also has a complimentary and opposing second molding surface 820. In the exemplary embodiment illustrated second molding surface 820 has a "male" configuration that is configured to be inserted into the open recess of first molding surface 810.

First molding surface 810 and second molding surface 820 are made to impart the desired shape and/or ornamental portions 320 to the aesthetic wall skin sheet body to be produced when the first molding surface 810 and the second molding surface 820 are brought together. In the exemplary embodiment illustrated in FIGS. 11-12 it is the second molding surface 820 that is shaped to impart the desired raised ornamental portions 320 on display surface 330 with first molding surface 810 making a flat bottom hidden surface 340. It should be noted that the particular configuration illustrated in FIGS. 11-12 is merely exemplary and not limiting. The first molding surface 810 and second molding surface 820 may be configured and shaped in any number of ways to impart a desired shape to the wall skin sheet body 315 to be produced.

Referring to FIG. 12, after fluid wall skin body composition 830 is applied to first molding surface 810 mold 800 is moved into a closed configuration with first molding surface 810 and second molding surface 820 being brought together to create a forming space 840 between them. Forming space 840 contains the wall skin composition 830 in the desired shape of the wall skin sheet to be produced. Wall skin body composition 830 is then solidified in the mold by applying suction, pressure and/or heat.

In conventional Type 1 slush molding fluid wall skin body composition 830 is solidified by applying suction to fluid wall skin body composition 830 which removes liquid. However, the solid wall skin sheet body 315 produced in the mold by slush molding will still be "wet" and have enough fluid content remaining that it will need to be further dried upon removal from mold 800, typically in a heated oven.

Due to problems that can arise when oven drying a "wet" wall skin the preferred method for manufacture of the wall skin sheet body 315 of the present invention is the use of Type 3 thermoform molding. In the contemplated thermoform molding process used to manufacture the wall skin sheet body 315 of the present invention second molding surface 820, or first molding surface 810, or both second molding surface 820 and first molding surface 810 are heated. Wall skin body composition 830 remains in the forming space 840 until it is fully solid and dry. First molding surface 810 is then separated from second molding surface 820 and the now solidified wall skin sheet body 315 is removed from mold 800.

Examples of tools and techniques that might be used in Type 3 thermoforming the wall skin sheets of the present invention include, by way of example and not limitation, those described and shown in U.S. Pat. 8,246,784 (Nilsson et al) and U.S. Pat. 9,243,369 (Huang) the contents of each of which are hereby fully incorporated by reference.

Referring to FIG. 13, in a preferred embodiment of the present wall skin sheet invention backer guide 350 is attached to the bottom hidden surface 340 of wall skin body 315. In the illustrated embodiment of FIG. 13 backer guide 350 is manufactured separately from wall skin body 315, and backer guide 350 is then attached wall skin body 315 to form a complete wall skin sheet 310 of the present invention. It is contemplated that backer guide 350 may be attached to wall skin body 315 by any suitable attachment means including by way of example and not limitation adhesives (e.g. glue or tape) and/or mechanical fasteners (e.g. staples, tacks, nails, screws, hook and loop). It is contemplated that backer guide 350 may have the same composition (e.g. molded pulp fiber) as wall skin body 315, and that backer guide 350 may be manufactured separately using the same molding process described herein from wall skin body 315.

In an alternative contemplated embodiment a mold 800 may be used such that backer guide 350 and wall skin sheet body 315 may be manufactured as a single unit from the same wall skin body composition 830. In such a contemplated alternative embodiment mold 800 would have a forming space 840 configured to be the shape of the combined wall skin body 315 and backer guide 350. Finished wall skin 310 with an upper display surface 330 having ornamental portions 320 and backer guide 350 beneath display surface 330 would emerge from mold 800 as a single body of unitary composition.

Figure 4:
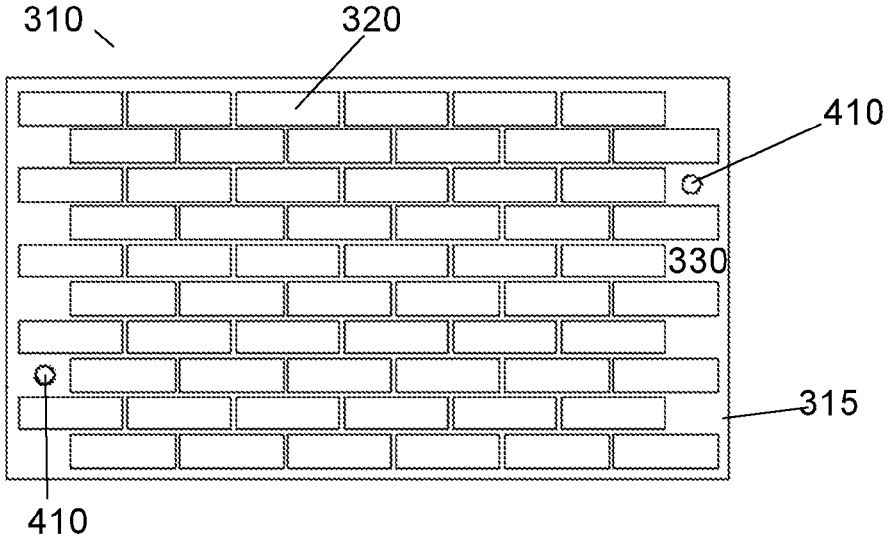
FIG. 4 is a top view of a wall skin sheet molded part with locators before die cutting.
Figure 5:
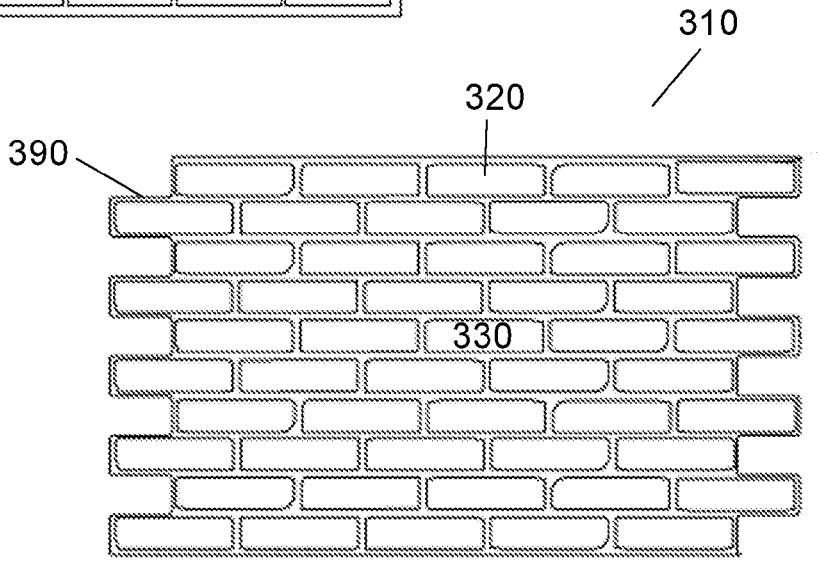
FIG. 5 is a top view of a wall skin sheet after die cutting.

Referring to FIG. 4, it is contemplated that wall skin sheet locators 410 (e.g. holes, depressions, protrusions, pegs etc...) are preferably included in wall skin sheet body 315. Locators 410 are used in die cutting to aid in cutting with the desired accuracy and consistency aesthetic wall skin sheet bodies 315 to a shaped pattern having body 315 with periphery edge 390 that preferably extends past the outermost edge of ornamental portions 320 as shown in FIG. 5.

Figure 6:
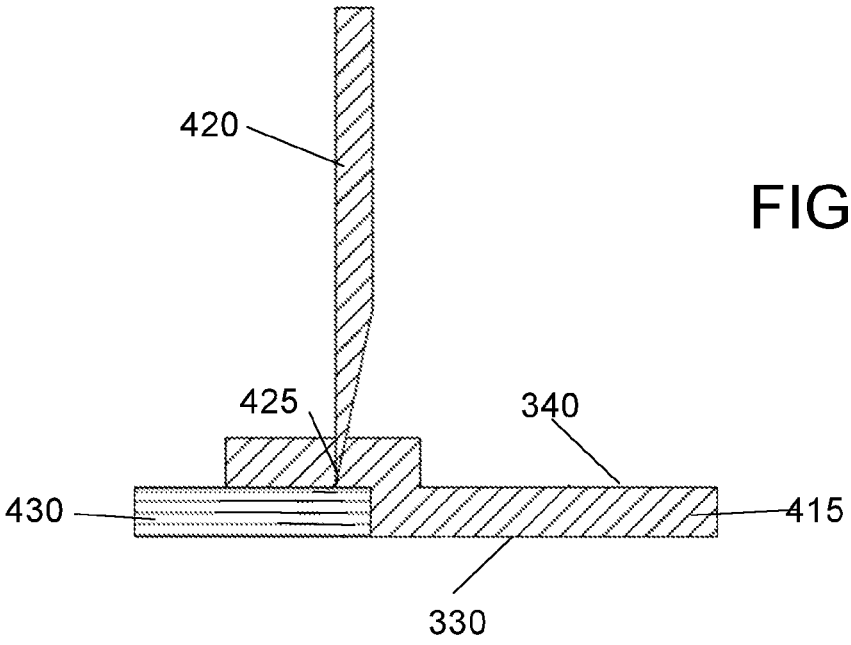
FIG. 6 is a front cross-sectional view of a die blade cutting a wall skin sheet with the top side facing down.
Figure 7:
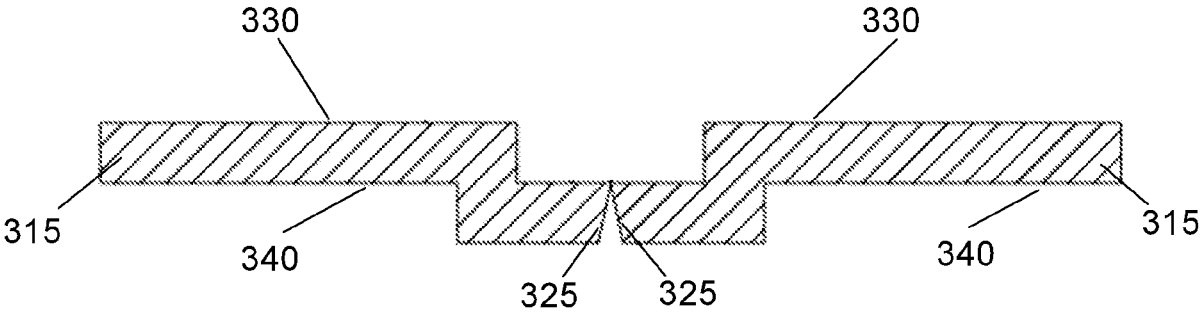
FIG. 7 is a front cross-sectional view of a seam formed by peripheral edges of two adjacent wall skin sheets showing the benefit of die cutting with the top surface facing down.

Referring to FIGS. 6 and 7, in the preferred process of manufacturing aesthetic wall skin sheets of the present invention the aesthetic wall skin sheet bodies 315 that are obtained from the molding process are die-cut using a die blade 420 and die platen 430 with top display surface 330 facing down so that when adjacent wall skin sheet joining edges 525 are brought together the seam will be very tight with no visually perceptible gap. This is because die blade 420 generally has the sharpest point 425 reaching the lowest point of the object being cut.

It is contemplated that top display surface 330, including ornamental portions 320, may have one or more coatings applied to it to impart colors, designs, and/or images to convey the desired visual impression (e.g. red clay brick, river rocks, etc....). One preferred method of accomplishing this is to use an industrial digital printing press.

Use of an industrial digital printing press is contemplated to involve placement of aesthetic wall skin sheet body 315 onto a conveyer belt or table system used for moving and/or positioning the aesthetic wall skin sheet body 315 in the digital printing press during printing. It is contemplated that, as is often the case, the aesthetic wall skin sheet body 315 would be secured in place on the conveyer belt under suction pressure from a vacuum system. Aesthetic wall skin sheet bodies 315 of the present invention made with the preferred Type 3 molded fiber product thermoforming process will be thinner and easier to secure under vacuum pressure to a conveyor belt or table system of a digital printing press. They will also have a better front surface for printing on. Digital art files used for printing the aesthetic wall skin sheets may need to be adjusted to account for the wall skin sheet body 315 material composition and/or embossed contours of the ornamental portions 320.

Figure 8:
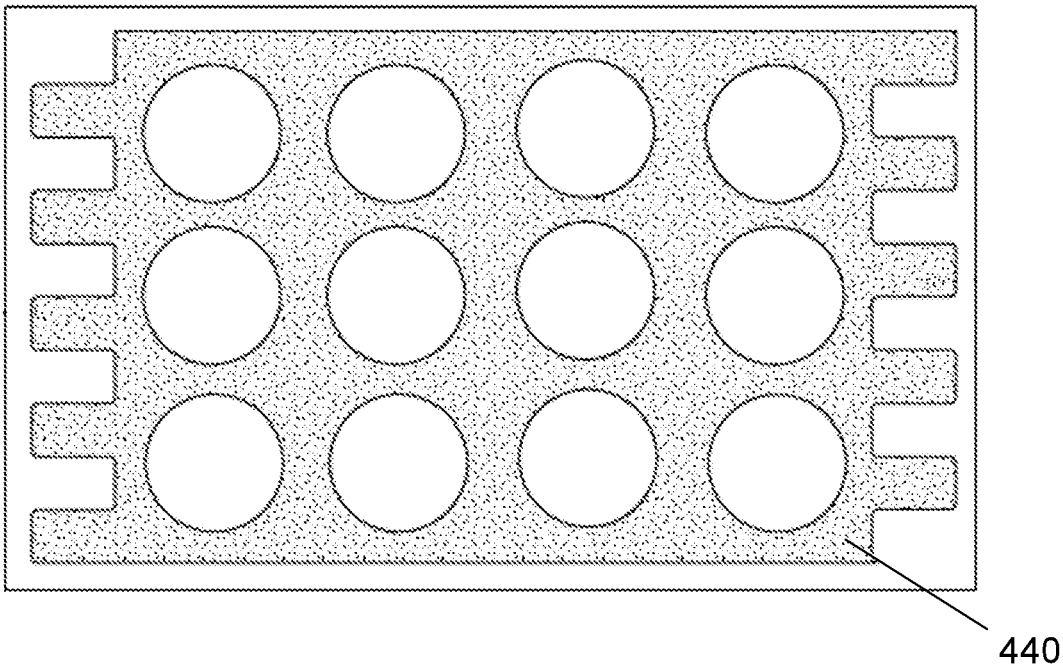
FIG. 8 is a top view of a jig with a cut-out pattern and ventilation holes that may be used to keep in position a wall skin sheet on a conveyor belt or table system of a digital printing press.
Figure 9:
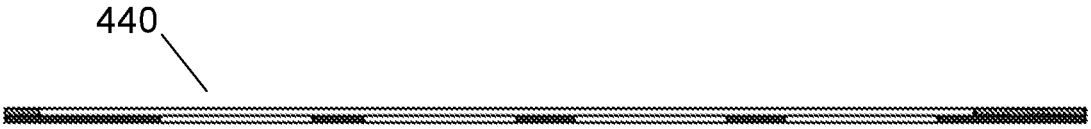
FIG. 9 is a front view of the jig of FIG. 8.
Figure 10:
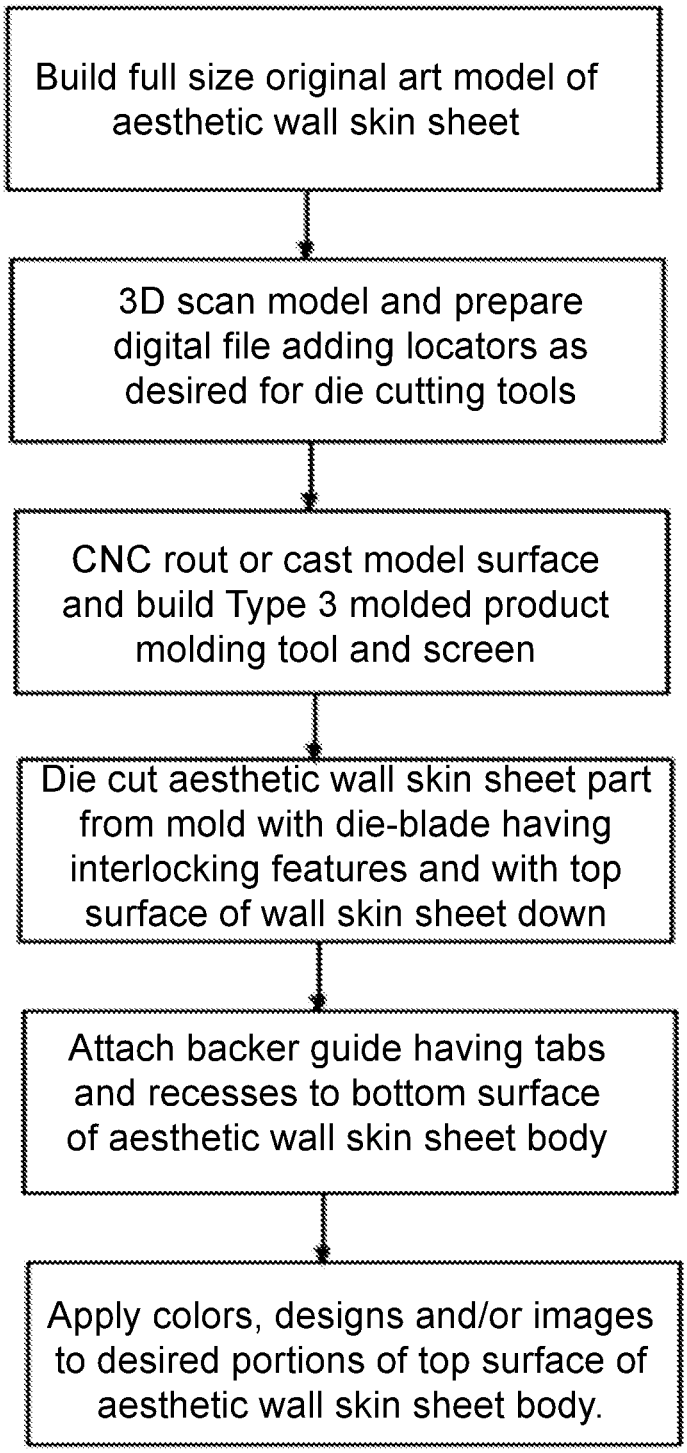
FIG. 10 is a flowchart of the overall preferred method of producing a finished aesthetic wall skin sheet with backer guide of the present invention.

Referring to FIGS. 8 and 9 an exemplary embodiment of a printing press jig 440 is shown. It is contemplated that utilizing a jig to help secure the aesthetic wall skin sheet body 315 to the conveyor belt or table system of the digital printing press will be beneficial. This is particularly so if the top display surface 330 of the aesthetic wall skin sheet body 315 is to be printed prior to attaching the backer guide 350 to wall skin sheet body 315.

The description and illustrations herein disclose exemplary embodiments and uses of applicants prior and present inventions. The prior and present inventions are susceptible to modifications in the configurations and uses, as well as alterations in the manufacturing methods and equipment. Consequently, it is not intended that present invention claimed herein be limited to the specific embodiments disclosed herein, but that it cover all modifications and alternatives coming within the true scope and spirit of the invention as embodied in the attached claims.

The invention claimed is:

1. A solid wall skin sheet comprising:
a substantially planar solid wall skin sheet body;
said solid wall skin sheet body having a top display surface; a bottom hidden surface, and a periphery edge;
said display surface having an ornamental portion;
a backer guide located beneath said display surface; and
said backer guide having a tab and a recess.

2. The solid wall skin sheet of claim 1 further comprising said tab having a fastener area that extends out beyond said periphery edge.

3. The solid wall skin sheet of claim 1 where said backer guide is a separate component attached to said hidden surface.

4. The solid wall skin sheet of claim 1 wherein said solid wall skin sheet body comprises molded pulp.

5. The solid wall skin sheet of claim 1 wherein said solid wall skin sheet body comprises molded pulp having a recycled paper fiber component.

6. The solid wall skin sheet of claim 1 further comprising a coating on said display surface.

7. The solid wall skin sheet of claim 6 where said coating comprises an ink.

8. The solid wall skin sheet of claim 1 manufactured by a process comprising the steps of:
applying a fluid wall skin sheet composition to a first molding surface of a mold;
positioning said first molding surface adjacent to a second molding surface of said mold to create a forming space containing said fluid wall skin sheet composition between said first molding surface and said second molding surface;
applying heat to said fluid wall skin sheet composition contained in said forming space until said wall skin sheet composition becomes solid; and
removing said solid wall skin sheet from said mold.

9. The solid wall skin sheet of claim 1 as manufactured by the process of claim 8 further comprising the step of applying pressure to said fluid wall skin sheet composition in said forming space.

10. The solid wall skin sheet of claim 1 as manufactured by the process of claim 8 further comprising the step of die-cutting said solid wall skin sheet using a die blade and die platen.

11. The solid wall skin sheet of claim 1 as manufactured by the process of claim 8 further comprising the step of applying a coating to said display surface.

12. The solid wall skin sheet of claim 11 where said coating is an ink.

13. The solid wall skin sheet of claim 3 manufactured by a process comprising the steps of:
applying a fluid wall skin sheet composition to a first molding surface of a mold;
positioning said first molding surface adjacent to a second molding surface of said mold to create a forming space containing said fluid wall skin sheet composition between said first molding surface and said second molding surface;

applying heat to said fluid wall skin sheet composition contained in said forming space until said wall skin sheet composition becomes said solid wall skin sheet body;

removing said solid wall skin sheet body from said mold; and attaching said backer guide to said solid wall skin sheet body.

14. The solid wall skin sheet of claim 3 as manufactured by the process of claim 13 further comprising the step of applying pressure to said fluid wall skin composition in said forming space.

15. The solid wall skin sheet of claim 3 as manufactured by the process of claim 13 further comprising the step of die-cutting said solid wall skin sheet using a die blade and die platen.

16. The solid wall skin sheet of claim 3 as manufactured by the process of claim 13 further comprising the step of applying a coating to said display surface.

17. The solid wall skin sheet of claim 16 where said coating is an ink.

18. The solid wall skin sheet of claim 3 as manufactured by the process of claim 13 wherein said wall sheet skin composition is a pulp mixture.

19. The solid wall skin sheet of claim 3 as manufactured by the process of claim 13 where said wall sheet skin composition is a recycled-paper pulp mixture.

* * * * *